US007264236B2

(12) United States Patent
Obuchi et al.

(10) Patent No.: US 7,264,236 B2
(45) Date of Patent: Sep. 4, 2007

(54) SHEET PROCESSING APPARATUS AND IMAGE FORMING APPARATUS HAVING SUCH SHEET PROCESSING APPARATUS

(75) Inventors: Yusuke Obuchi, Chiba (JP); Hitoshi Kato, Ibaraki (JP); Hiroshi Suzuki, Ibaraki (JP); Tetsuya Terada, Ibaraki (JP)

(73) Assignees: Canon Finetech Inc., Mitsukaido-Shi (JP); Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/287,255

(22) Filed: Nov. 28, 2005

(65) Prior Publication Data

US 2006/0076724 A1 Apr. 13, 2006

Related U.S. Application Data

(62) Division of application No. 10/784,953, filed on Feb. 25, 2004, now Pat. No. 6,997,449.

(30) Foreign Application Priority Data

Mar. 7, 2003 (JP) ..... 2003-062542

(51) Int. Cl.
*B41L 43/12* (2006.01)

(52) U.S. Cl. ..... 270/37; 270/32; 270/58.07; 270/58.08; 493/416; 399/407

(58) Field of Classification Search ..... 270/32, 270/37, 58.07, 58.08; 493/416; 399/407
See application file for complete search history.

(56) References Cited

U.S. PATENT DOCUMENTS 4,917,366 A * 4/1990 Murakami et al. ..... 270/58.09
5,168,290 A 12/1992 Tanaka et al. ..... 346/134
5,239,347 A 8/1993 Onodera et al. ..... 355/274
5,321,486 A 6/1994 Nanbu et al. ..... 355/311
5,555,082 A 9/1996 Tanaka et al. ..... 355/309
5,676,363 A 10/1997 Kishida et al. ..... 271/10.01
6,217,016 B1 4/2001 Honmochi et al. ..... 270/37
6,268,909 B1 7/2001 Honmochi et al. ..... 355/407
6,371,471 B1 4/2002 Fukazu et al. ..... 270/58.09
6,381,443 B1 * 4/2002 Kawata et al. ..... 399/407
2002/0033569 A1 * 3/2002 Watanabe ..... 270/37

(Continued)

FOREIGN PATENT DOCUMENTS

JP 2001-26359 1/2001

*Primary Examiner*—Gene O. Crawford
*Assistant Examiner*—Leslie A. Nicholson, III
(74) *Attorney, Agent, or Firm*—Fitzpatrick, Cella, Harper & Scinto

(57) ABSTRACT

A pressing member is provided on a shutter member provided in a main body of an apparatus and adapted to open and close a folded sheet discharging port upon upward and downward shifting movement of sheet stacking means in such a manner that, after folding processing is performed by folding means as the shutter member is lowered, a sheet discharged onto folded sheet stacking means is pressed down by the pressing member. Further, if there is any sheet on the folded sheet stacking means, by stopping the sheet stacking means at a predetermined position where the shutter member lightly abuts against the sheet discharged on the folded sheet stacking means, the sheet is prevented from being pinched between the shutter member and the sheet stacking means.

2 Claims, 5 Drawing Sheets

U.S. PATENT DOCUMENTS

2003/0044186 A1 3/2003 Kato et al. ..... 399/16
2003/0184010 A1 10/2003 Kato et al. ..... 271/207
2003/0235328 A1 12/2003 Nakamura et al. ..... 382/112
2003/0235448 A1 12/2003 Nemura et al. ..... 399/389

* cited by examiner

SHEET PROCESSING APPARATUS AND IMAGE FORMING APPARATUS HAVING SUCH SHEET PROCESSING APPARATUS

This is a divisional of U.S. patent application Ser. No. 10/784,953, filed Feb. 25, 2004, now U.S Pat. No. 6,997,449.

BACKGROUND OF THE INVENTION

1. Field of the Invention

The present invention relates to a sheet processing apparatus having folding means for folding a sheet on which an image was formed, and an image forming apparatus having such a sheet processing apparatus. More specifically, the present invention relates to a sheet processing apparatus which can be made compact and can prevent damage of a sheet, and an image forming apparatus having such a sheet processing apparatus.

2. Related Background Art

Conventionally, regarding image forming apparatuses such as copiers, printing machines, laser beam printers and the like, there has been proposed a sheet processing apparatus in which, for example, after sheets on which images were formed and discharged from a main body of the image forming apparatus are successively received, the sheets are conveyed to folding means, where double-folding processing is carried out, and, thereafter, the sheets are discharged onto a sheet stacking portion (refer to Japanese Patent Application Laid-open No. 2001-26359).

FIG. 5 is a schematic constructional view of a conventional sheet processing apparatus having such a construction. As shown in FIG. 5, a sheet processing apparatus 1000 includes conveying rollers 203, a sheet stopper 205, a stapler 206, a thrusting plate (folding means)209, a pair of folding rollers 208, sheet discharging rollers 210 and a stacking tray (sheetstack stacking means) 211, in order to perform such folding processing.

Here, in the sheet processing apparatus 1000, a sheet discharged from a main body of an image forming apparatus (not shown) and conveyed into the sheet processing apparatus is firstly conveyed by the conveying rollers 203 until a leading end of the sheet reaches the sheet stopper 205, and, thereafter, lateral sides of the sheet reached to the sheet stopper 205 are aligned by sheet aligning means (not shown).

By repeating such operations with respect to a plurality of sheets, the plurality of sheets are stacked on the sheet stopper 205 and, then, stapling processing is performed by the stapler 206. Thereafter, by thrusting the thrusting plate 209 toward a central portion of the stacked sheets, the sheet stack is advanced into a nip of the folding roller pair 208, so that the sheet stack is double-folded by the folding roller pair 208. Thereafter, the double-folded sheet stack is discharged by the sheet discharging rollers 210 onto the stacking tray 211 through a stack discharging outlet 611 provided at a lower part of a main body 1001 of the sheet processing apparatus.

By the way, in a case where the sheet stack so double-folded is discharged onto the stacking tray 211, since the sheet stack is swollen upwardly in a folded portion at a discharging side end, if a plurality of sheet stacks are stacked on the stacking tray 211, a discharging downstream side of the sheet stacked on the stacking tray 211 will be swollen upwardly.

If the discharging sides of the sheet stacks are swollen in this way, since subsequent discharging of the sheet stack onto the stacking tray cannot be performed properly, as shown in FIG. 5, a pressing member 212 for pressing the discharging downstream sides of the sheet stacks is provided above the stacking tray 211 for a rotational movement around a fulcrum 216.

On the other hand, in FIG. 5, there are also provided a sample tray 701 on which sheets passed through a non-sort path 521 after conveyed from the main body of the image forming apparatus (not shown) are stacked, and a stack tray 700 on which sheets after passed through a sort path 522 and subjected to aligning processing, if necessary, and stapling processing effected by a stapler 601 are discharged.

By the way, the stack tray 700 can be moved in an up-and-down direction so that, as a sheet stacking amount is increased, the stack tray is shifted downwardly. When the stack tray 700 is shifted downwardly to pass by the stack discharging outlet 611, the sheets stacked on the stack tray 700 may enter into the stack discharging outlet 611.

To avoid this, in the past, the main body 1001 of the sheet processing apparatus is provided with a shutter member 613 for opening and closing the stack discharging outlet 611 so that, when the stack tray 700 is lowered, by lowering the shutter member 613 together with the stack tray 700, the stack discharging outlet 611 is closed. By closing the stack discharging outlet 611 upon lowering of the stack tray 700, the sheets stacked on the stack tray 700 are prevented from entering into the stack discharging outlet 611.

Incidentally, the shutter member 613 is biased upwardly by an extension spring 615 so that the shutter member 613 is normally held at a position for opening the stack discharging outlet 611 and, when the stack tray 700 is lifted, the shutter member is lifted by following the stack tray 700, thereby opening the stack discharging outlet 611.

However, in the conventional sheet processing apparatus having the above-mentioned shutter member 613 and pressing member 212 and an image forming apparatus having such a sheet processing apparatus, in a case where the pressing member 212 is protruded from the stack discharging outlet 611 out of the main body 1001 of the sheet processing apparatus, since the pressing member 212 constitutes an obstruction, the shutter member 613 cannot be lowered adequately. To avoid this, as shown in FIG. 5, the pressing member 212 is provided within the main body 1001 of the sheet processing apparatus.

However, in a case where the pressing member 212 is provided within the main body 1001 of the sheet processing apparatus in this way, a lateral dimension of the main body 1001 of the sheet processing apparatus is increased, which makes the sheet processing apparatus 1000 bulky, with the result that the image forming apparatus having the sheet processing apparatus 1000 is also made bulky. Further, in the case where the pressing member 212 is disposed within the apparatus, the sheet stacks to be discharged and stacked also remain within the apparatus, which causes a problem that it is difficult to take out the sheet stack.

On the other hand, in the case where the pressing member 212 is provided within the main body 1001 of the sheet processing apparatus, although the shutter member 613 can be lowered adequately, if the shutter member 613 is lowered too great, the sheet stack may be pinched between the shutter member and the stacking tray 211. If the sheet stack is so pinched, the sheet stack may be damaged.

SUMMARY OF THE INVENTION

The present invention is made in consideration of the above-mentioned circumstances, and an object of the present invention is to provide a sheet processing apparatus which can be made compact and can prevent damage of a sheet, and an image forming apparatus having such a sheet processing apparatus.

To achieve the above object, the present invention provides a sheet processing apparatus having folding means for folding a sheet on which an image was formed and in which the sheet folded by the folding means is discharged onto a folded sheet stacking portion through a folded sheet discharging port, comprising sheet stacking means provided in a main body of the apparatus for a shifting movement in an up-and-down direction and adapted to stack a sheet discharged from an upper discharging port provided above the folded sheet discharging port without passed through the folding means, a shutter member provided in a main body of the apparatus for a shifting movement in an up-and-down direction and adapted to be lifted and lowered upon upward and downward shifting movements of the sheet stacking means to open and close the folded sheet discharging port, and a pressing member provided on the shutter member and adapted to push the sheet stacked on the folded sheet stacking portion.

Further, in the present invention, there is further provided position control means for stopping the sheet stacking means at a predetermined position where the shutter member lightly abuts against the sheet stacked on the folded sheet stacking portion when the sheet stacking means are lowered in a condition that the sheet is stacked on the folded sheet stacking portion.

Further, in the present invention, the position control means include folded sheet detecting means for detecting the sheet stacked on the folded sheet stacking portion and position detecting means for detecting the fact that the sheet stacking means reach the predetermined position where the shutter member lightly abuts against the sheet stacked on the folded sheet stacking portion.

Further, in the present invention, position detecting means are provided at a position where the position detecting means detect the sheet stacking means reached the predetermined position where the shutter member lightly abuts against the sheet stacked on the folded sheet stacking portion.

Further, in the present invention, the position detecting means are designed so that the position detecting means detect the fact that the sheet stacking means reach the predetermined position where the shutter member lightly abuts against the sheet stacked on the folded sheet stacking portion, on the basis of a sheet stacking height of the sheet stacked on the sheet stacking means.

Further, the present invention provides an image forming apparatus comprising an image forming portion for forming an image on a sheet, and one of sheet processing apparatuses as mentioned above.

As mentioned above, as is in the present invention, by providing, on the shutter member, the pressing member for pushing the sheet discharged on the folded sheet stacking portion, the apparatus can be made compact, and a large number of sheets can be stacked by lowering the shutter member and the pressing member by means of the stack tray when there is no sheet on the folded sheet stacking portion. Further, in a case where there is any sheet on the folded sheet stacking portion, by stopping the sheet stacking means at a position where the shutter member does not abut against the sheet discharged on the folded sheet stacking portion, the sheet can be prevented from being pinched between the shutter member and the folded sheet stacking portion, thereby preventing damage of the sheet.

DESCRIPTION OF THE PREFERRED EMBODIMENTS

Now, embodiments of the present invention will be fully explained with reference to the accompanying drawings.

Figure 1:
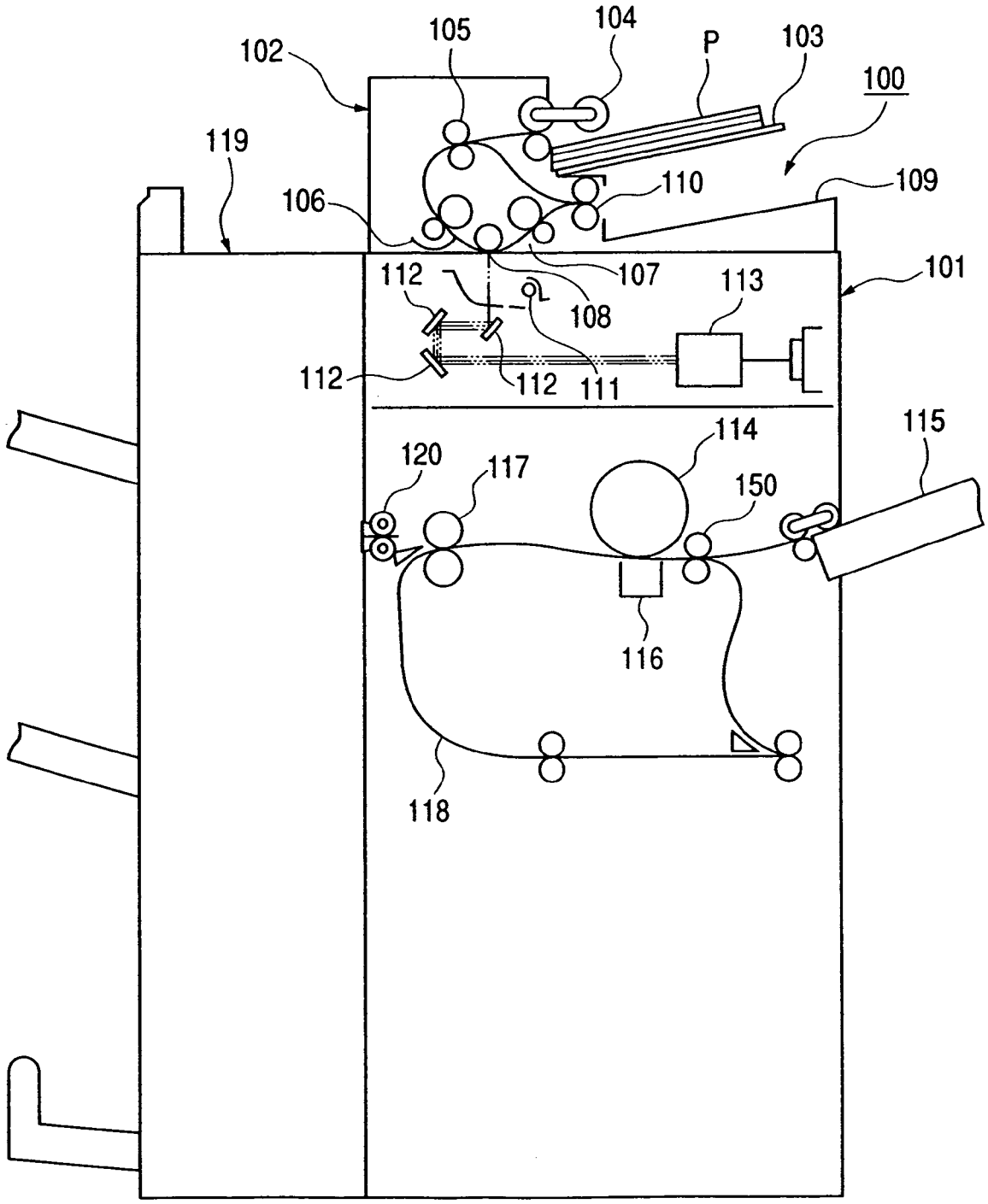
FIG. 1 is a view showing a schematic construction of a copier as an example of an image forming apparatus having a sheet processing apparatus according to a first embodiment of the present invention.

FIG. 1 is a view showing a schematic construction of a copier as an example of an image forming apparatus having a sheet processing apparatus according to a first embodiment of the present invention.

In FIG. 1, a copier 100 is constituted by a main body 101 of an apparatus and a finisher 119 as a sheet processing apparatus. A document or original feeding apparatus 102 is provided on an upper part of the main body 101 of the apparatus. Documents D are stacked on a document stacking portion 103 by an operator and are separated and fed one by one by means of a feeding portion 104 to a pair of registration rollers 105. Then, the document D is temporarily stopped by the registration roller pair 105 so that a loop is formed in the document to correct skew-feeding. Thereafter, the document D is passed through an introduction path 106 and then is passed through a reading position 108 where an image formed on a surface of the document is read. The document D passed through the reading position 108 is passed through a discharging path 107 and then is discharged onto a discharging tray 109.

Further, in a case where both surfaces of the document are read, first of all, an image on one surface of the document is read by passing the document through the reading position 108 as mentioned above. Thereafter, the document D is passed through the discharging path 107 and then is switch-back-conveyed by a pair of turn over rollers 110, so that the document is conveyed to the registration roller pair 105 again in a condition that a front surface of the document is reversed to a rear surface thereof.

Then, similar to the reading of one surface of the document, the skew-feeding of the document D is corrected by the registration roller pair 105 and then the document is passed through the introduction path 106 to reach the reading position 108 where an image on the other surface is read. Then, the document D is passed through the discharging path 107 and is discharged onto the discharging tray 109.

On the other hand, the document passing through the reading position 108 is illuminated by light from an illumination system 111, and, thereafter, reflection light reflected from the document is directed to an optical element (CCD or other element) 113 by means of a mirror 112, where the light is converted into image data. Then, by illuminating a laser beam onto a photosensitive drum 114 on the basis of the image data, a latent image is formed on the photosensitive drum. Further, thereafter, the latent image formed on the photosensitive drum 114 is developed by toner supplied from a toner supplying apparatus (not shown), thereby forming a toner image on the photosensitive drum 114.

Further, in synchronous with the formation of the toner image, a sheet such as a paper or a plastic film situated in a cassette 115 is fed out from the cassette 115 in response to a recording signal and is sent between the photosensitive drum 114 and a transferring device 116. Then, the toner image on the photosensitive drum 114 is transferred onto the sheet by the transferring device 116, and, thereafter, the sheet to which the toner image was transferred is sent to a fixing apparatus 117, where the toner image is fixed to the sheet by heat and pressure.

Incidentally, in a case where images are formed on both surfaces of the sheet, the sheet to which the image was fixed onto one surface of the sheet by the fixing apparatus 117 is passed through a both-face path 118 provided at a downstream side of the fixing apparatus 117 and then is sent between the photosensitive drum 114 and the transferring device 116 of an image forming portion again, where a toner image is also transferred onto a rear surface of the sheet. Then, the toner image is fixed onto the rear surface, and the sheet is discharged outside (toward the finisher 119).

Figure 2:
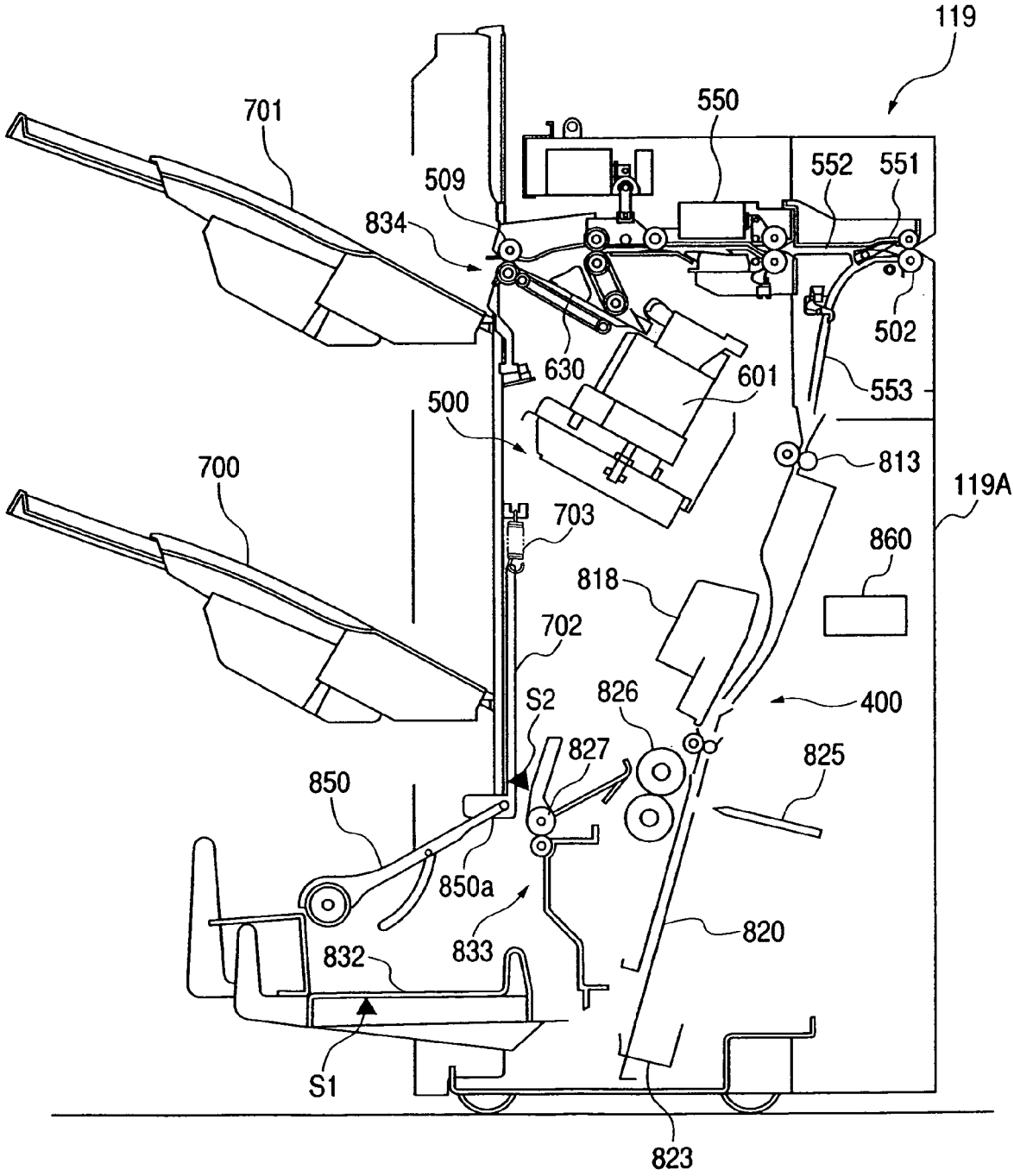
FIG. 2 is a schematic constructional view of the sheet processing apparatus.

On the other hand, the finisher 119 successively receives the sheets discharged from the main body 101 of the apparatus and performs various processing operations such as processing for aligning the received plural sheets and for bundling the sheets as a single stack, stapling processing for stapling the bundled sheet stack, sorting processing, non-sorting processing and book binding processing. As shown in FIG. 2, the finisher includes a folding apparatus 400, a processing portion 500 and the like.

As shown in FIG. 2, the processing portion 500 includes a pair of inlet rollers 502 for directing the sheet conveyed from the main body 101 (FIG. 1) of the apparatus toward inside, and a flapper 551 for directing the sheet to a non-sort path 552 in a non-sort mode and a sort mode and to a book binding path 553 in a folding mode.

In case of the non-sort mode, the sheet directed into the non-sort path 552 by the flapper 551 is discharged onto the sample tray 701 of a normal rotation of a pair of reversible sheet discharge conveying rollers 509.

Further, in case of the sort mode, the sheet directed into the sort path 552 by the flapper 551 is stacked onto an intermediate tray (referred to as "processing tray" hereinafter) 630 by a reverse rotation after a predetermined amount normal rotation of the pair of sheet discharge conveying rollers 509. Incidentally, the sheets stacked on the intermediate tray as a bundle are subjected to aligning processing if necessary and stapling processing effected by a stapler 601 and then are discharged onto a stack tray 700 as sheet stacking means designed to be shifted in an up-and-down direction, by means of the pair of sheet discharge conveying rollers 509.

On the other hand, the folding apparatus 400 includes two pairs of staplers 818, and a pair of folding rollers 826 as folding means for folding the sheet. The sheet sent from the book binding path 553 is housed in a housing guide 820 by a pair of conveying rollers 813 and, thereafter, the sheet is conveyed until a leading end of the sheet is contacted with a positioning member 823 which is shiftable in an up-and-down direction.

Here, there is a provided a thrusting member 825 as thrusting means in a confronting relationship to the pair of the folding rollers 826 with the interposition of the housing guide 820. By thrusting the thrusting member 825 opposed to the pair of folding rollers 826 toward the sheet stack housed in the housing guide 820, the sheet stack is pushed out into a nip portion as a folding portion of the folding roller pair 826 to be folded by the folding roller pair 826. Thereafter, the folded sheet stack is discharged onto a saddle discharging tray 832 as a folded sheet stacking portion by a pair folded sheet discharging rollers 827.

Incidentally, in a case where the sheet stack stapled by the stapler 818 is folded, after the stapling processing is finished, the positioning member 823 is lowered by a predetermined distance so that a stapled position of the sheet stack is situated at a central portion of the folded roller pair 826.

By the way, in FIG. 2, there are also provided a stack discharging port as a folded sheet discharging port 833 for discharging the sheet stack subjected to the folding processing onto the saddle discharging tray 832, and a shutter member 702 provided on a main body 119A of the finisher for a shifting movement in an up-and-down direction and adapted to open and close the stack discharging port 833, and the shutter member 702 can be lowered as the stack tray 700 is lowered.

Incidentally, the shutter member 702 is biased upwardly by an extension spring 703 so that the shutter member 702 is normally held at a position for opening the stack discharging port 833 and, when the stack tray 700 is lifted, shutter member 702 follows the stack tray 700 to be lifted, thereby opening the stack discharging port 833.

Further, there is also provided a pressing member 850 disposed above the saddle discharging tray 832 and adapted to push down a discharge side of the sheet stack. By pressing down the discharge side of the sheet stack by means of the pressing member 850, a subsequent sheet stack can be discharged onto the saddle discharging tray properly.

Figure 5:
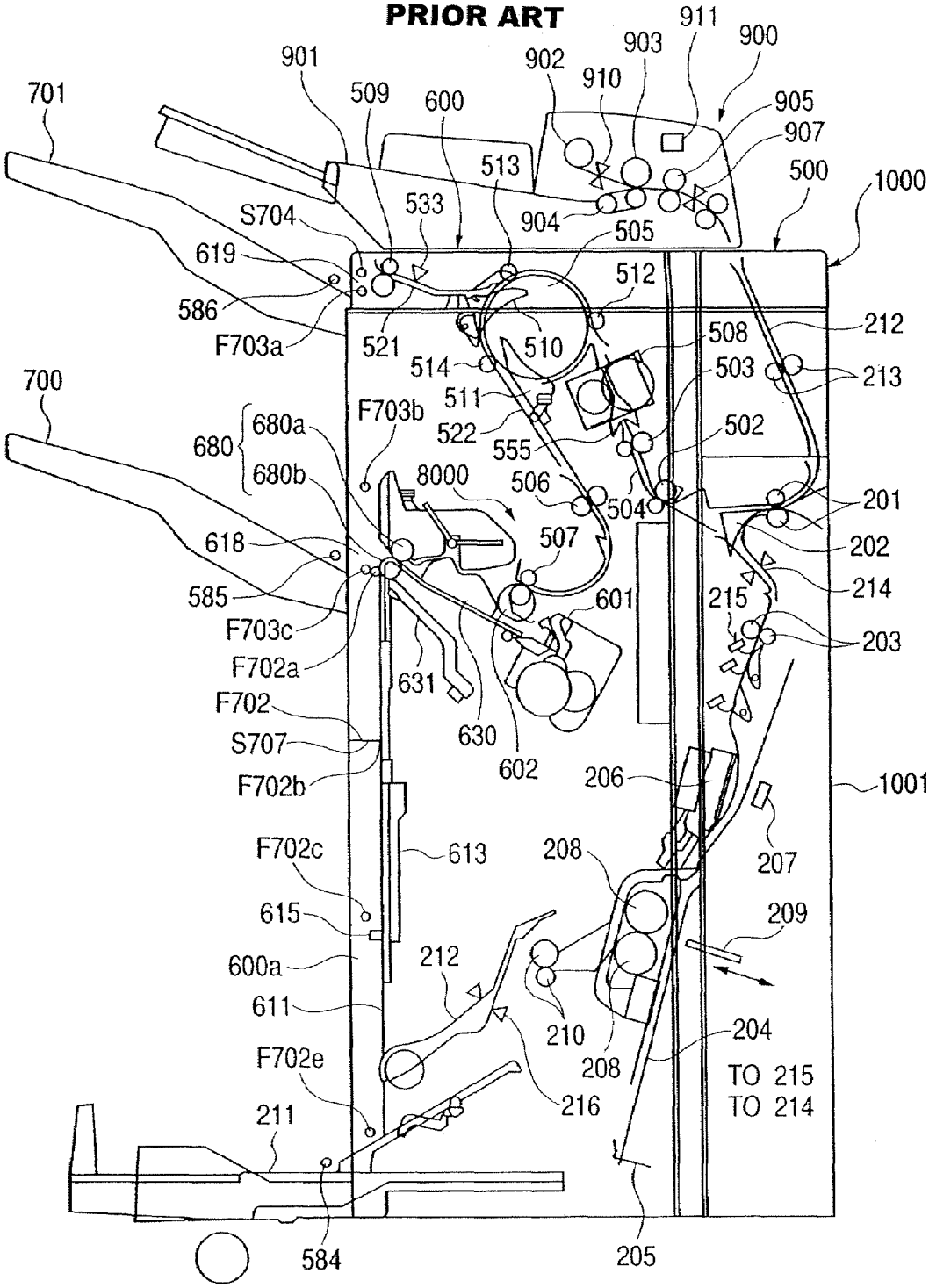
FIG. 5 PRIOR ART
FIG. 5 is a view showing a schematic construction of a conventional sheet processing apparatus.

The pressing member 850 is attached to a lower end portion of the shutter member 702. By providing the pressing member 850 at the lower end portion of the shutter member 702 in this way, a width-wise direction of the main body 119A of the finisher can be reduced in comparison with a case where the pushing member is provided within the main body of the finisher (refer to FIG. 5), thereby making the finisher 119 and therefore the copier 100 (FIG. 1) having the finisher 119 compact.

Figure 3:
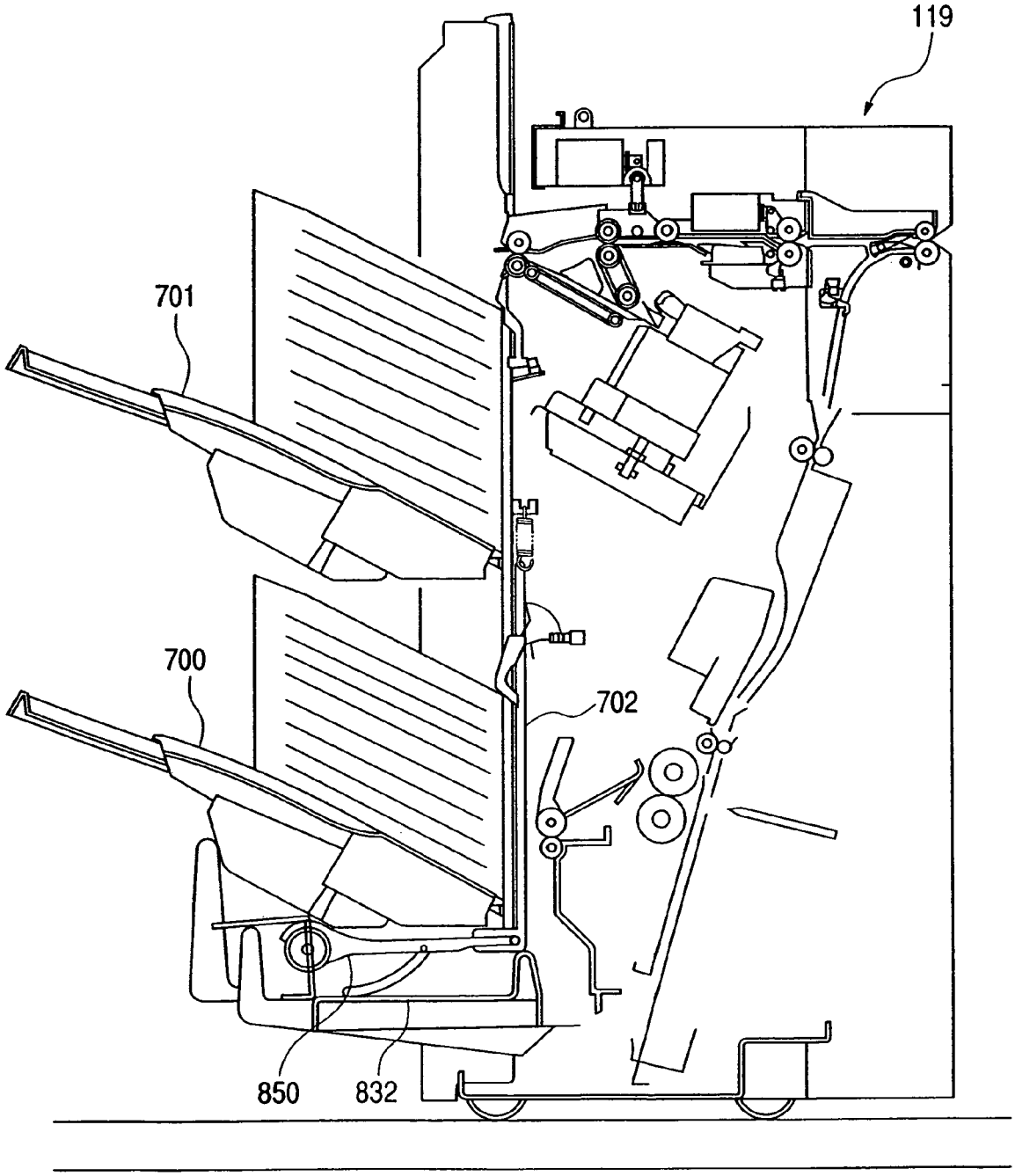
FIG. 3 is a view showing a condition that a pressing member is rotated upwardly when a shutter member is lowered together with a stack tray provided in the sheet processing apparatus.

Incidentally, in the illustrated embodiment, one end 850*a* of the pressing member 850 is rotatably supported at the lower end portion of the shutter member 702 so that, after the pressing member 850 abuts against the sheet stack as shown in FIG. 3, when stack tray 700 is lowered and the shutter member 702 is lowered accordingly, the pressing member 850 is rotated upwardly.

By rotating the pressing member 850 upwardly after it abuts against the sheet stack in this way, the stack tray 700 and the shutter member 702 can be lowered without obstructed by the pressing member 850. Incidentally, the pressing member 850 is held in a condition shown in FIG. 2 by a locking member (not shown) until it abuts against the sheet stack.

On the other hand, in FIG. 2, there are also provided a sheet stacking detecting sensor S1 as folded sheet detecting means provided on the saddle discharging tray 832 and adapted to detect the sheet stack discharged onto the saddle discharging tray 832, and a lower limit sensor S2 as position detecting means for detecting the fact that the stack tray 700 reaches a predetermined position (referred to as "lower limit position" hereinafter) where the shutter member 702 lightly abuts against the sheet discharged on the saddle discharging tray 832.

Detection signals from the sheet stack detecting sensor S1 and the lower limit sensor S2 are inputted into a control portion 860 provided in the main body 119A of the finisher (or the main body 101 of the apparatus. The control portion 860 causes the sheets discharged from an upper discharging port 834 provided above the stack discharging port 833 and not folded to be stacked on the stack tray 700 successively, and when the detection signal is inputted from the lower limit sensor S2 detecting the stack tray gradually lowered accordingly and reached the lower limit position, the control portion checks presence/absence from the sheet stack detecting sensor S1.

When the detection signal from the lower limit sensor S2 is inputted in this way, if the detection signal from the sheet stack detecting sensor S1 is inputted, i.e. if there is the sheet stack on the saddle discharging tray 832, a motor (not shown) for lifting and lowering the stack tray is stopped.

By providing the position control means constituted by the sheet stack detecting sensor S1, lower limit sensor S2 and control portion 860, if there is the sheet stack on the saddle discharging tray 832, by stopping the stack tray 700 at the lower limit position, the sheet stack can be prevented from being pinched between the shutter member 702 and the saddle discharging tray 832, thereby preventing the damage of the sheet stack.

By the way, in the above-mentioned explanation, while an example that the stack tray 700 reaching the lower limit position is directly detected by providing the lower limit sensor at the lower limit position of the stack tray 700 was explained, the present invention is not limited to such a example, but, for example, the fact that the stack tray 700 reaches the lower limit position may be detected on the basis of a sheet stacking height on the stack tray 700.

Figure 4:
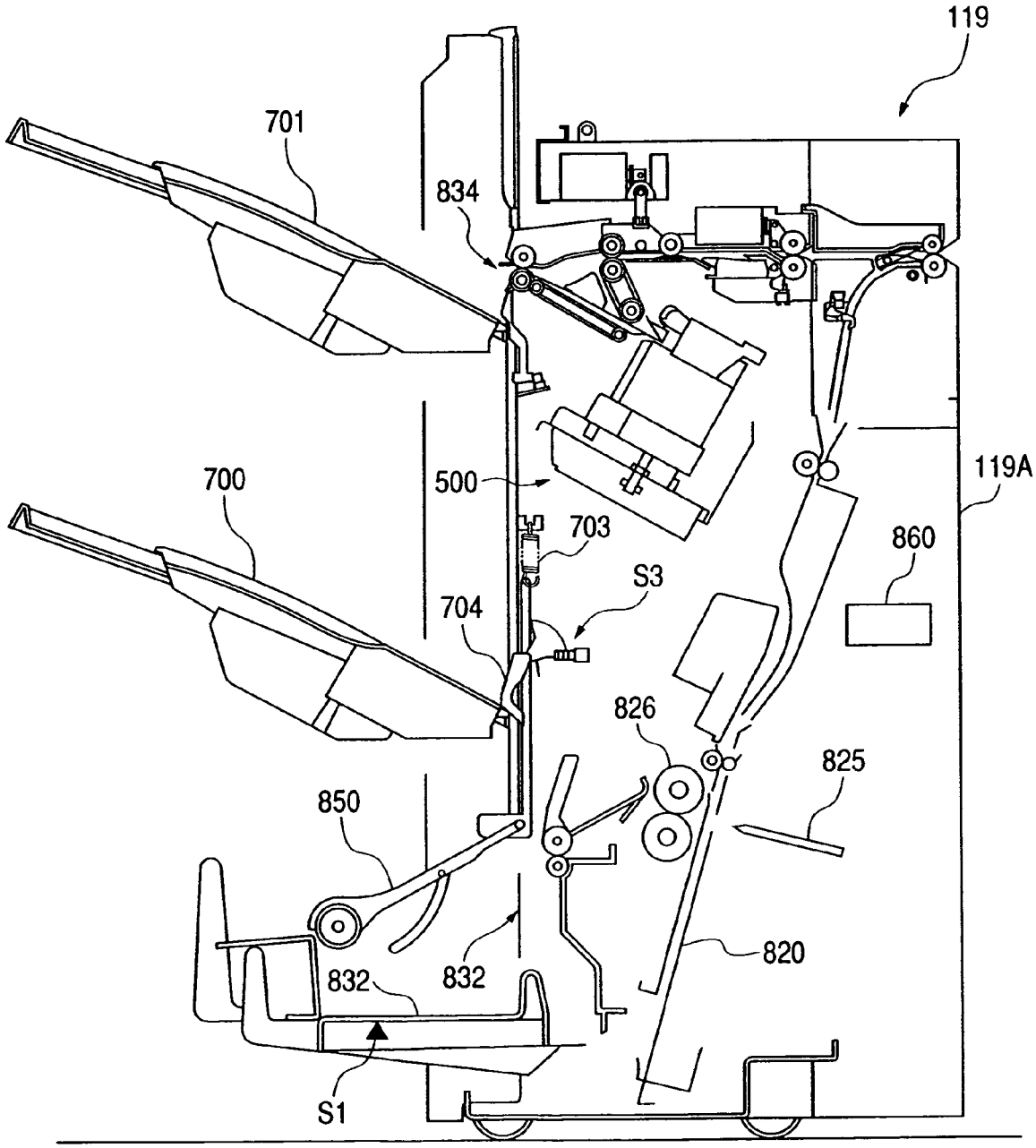
FIG. 4 is a schematic constructional view of a sheet processing apparatus according to a second embodiment of the present invention.

FIG. 4 is a view showing a schematic construction of the sheet processing apparatus according to a second embodiment of the present invention. Incidentally, in FIG. 4, elements same as or similar to those in FIG. 2 are designated by the same reference numerals.

In FIG. 4, a stacking height detecting sensor S3 serves to detect a stacking height of sheets stacked on the stack tray 700, and the stacking height detecting sensor S3 constitutes a part of the position control means for stopping the stack tray 700 at the lower limit position together with the above-mentioned sheet stack detecting sensor S1.

The stacking height detecting sensor S3 as position detecting means constituting the position control means together with the sheet stack detecting sensor S1 is turned ON by a flag 704 urged by an end of the sheet stack stacked on the stack tray 700 when the stack tray 700 is lowered, and output from the stacking height detecting sensor S3 is inputted to the control portion 860.

When the stack tray 700 is lowered, the stacking height detecting sensor S3 continues to be turned ON till an uppermost end of the sheet stack stacked on the stack tray 700; that is to say, an ON time of the stacking height detecting sensor S3 is lengthened in accordance with the height of the sheet stack stacked on the stack tray 700. The control portion 860 serves to detect the sheet stacking height on the basis of the ON time of the stacking height detecting sensor S3.

Since the position of the stack tray 700 can be detected by detecting the sheet stacking height, when the ON time of the stacking height detecting sensor S3 reaches a predetermined time, i.e. when the sheet stacking height reaches a predetermined value, the fact can be detected that the stack tray 700 reaches the lower limit position.

Incidentally, in the illustrated embodiment, while an example that the lower position of the stack tray 700 is detected by directly detecting the sheet stacking height was explained, so long as a thickness of the sheet is known, the sheet stacking height may not be detected directly, but, the fact that the stack tray 700 reaches the lower limit position may be detected by counting the number of sheets discharged onto the stack tray 700.

What is claimed is:

1. A sheet processing apparatus comprising:

a lower sheet stacker on which a sheet discharged from a lower sheet discharging port is stacked;

an upper sheet stacker on which a sheet discharged from an upper sheet discharging port is stacked, said upper sheet stacker being arranged to be movable in an up-and-down direction; and a shutter member which is lowered from a position for opening said lower sheet discharging port to close said lower sheet discharging port in association with lowering of said upper sheet stacker, wherein, when the sheet is stacked on said lower sheet stacker, said shutter member is lowered to a predetermined position where the sheet stacked on said lower sheet stacker is prevented from being pinched between said lower sheet stacker and said shutter member; and a pressing member which presses the sheet discharged on said lower sheet stacker, said pressing member being swingably mounted to said shutter member, wherein said pressing member is rotated relatively upward as a leading end portion of said pressing member abuts against the sheet stacked on said lower sheet stacker in association with lowering of said upper sheet stacker.

2. An image forming apparatus comprising an image forming portion which forms an image on the sheet, and a sheet processing apparatus according to claim 1, said sheet processing apparatus performing processing to the sheet on which the image is formed by said image forming portion.

* * * * *